United States Patent [19]

Seiler et al.

[11] 4,014,764

[45] Mar. 29, 1977

[54] PROCESS FOR DESILVERING USED BLEACH FIX BATHS

[75] Inventors: Adolf Seiler, Hitdorf; Heinz Meckl, Schildgen; Helmut Haseler, Leverkusen, all of Germany

[73] Assignee: AGFA-Gevaert, A.G., Leverkusen, Germany

[22] Filed: Apr. 17, 1972

[21] Appl. No.: 244,512

[30] Foreign Application Priority Data

July 8, 1971 Germany ..... 2134071

[52] U.S. Cl. ..... 204/109; 96/60 BF

[51] Int. Cl.[2] ..... C25C 1/22

[58] Field of Search ..... 204/109, 110, 111; 96/60 BF

[56] References Cited

UNITED STATES PATENTS

| | | | |
|---|---|---|---|
| 3,271,279 | 9/1966 | Poor | 204/108 |
| 3,634,088 | 1/1972 | Cooley | 96/60 BF |
| 3,642,594 | 2/1972 | Crellin | 204/109 |

FOREIGN PATENTS OR APPLICATIONS

| | | | |
|---|---|---|---|
| 945,542 | 5/1949 | France | 204/109 |

*Primary Examiner*—R. L. Andrews
*Attorney, Agent, or Firm*—Connolly and Hutz

[57] ABSTRACT

Photographic bleach fix baths are desilvered by electrolysis in a cell in which the cathode and anode chambers are separated by a diaphragm, with the exclusion of air, and the bleach fix bath is removed from the cell before the potential is switched off. For increasing the current yield the bleaching agent can be reduced prior to electrolysis for example by the addition of sodium dithionite.

5 Claims, 1 Drawing Figure

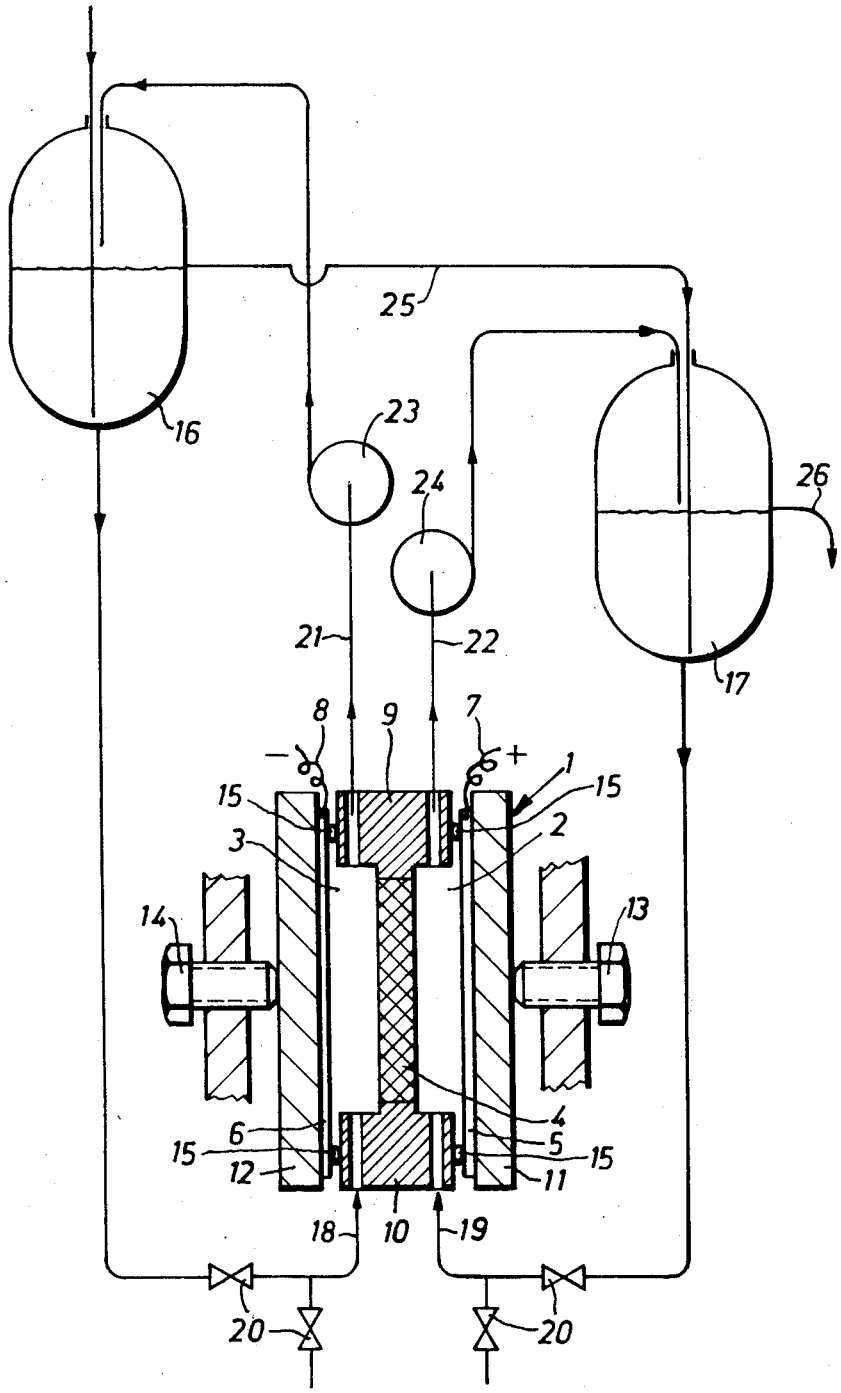
25
16
23
24
26
21
22
17
8
9
7
−
+
1
15
15
2
3
14
13
4
6
5
15
15
12
11
18
10
19
20
20

PROCESS FOR DESILVERING USED BLEACH FIX BATHS

The invention relates to a process for the electrolytic deposition of silver from used photographic bleach fix baths, in particular from bleach fix baths which contain complex salts of trivalent iron and aminopolycarboxylic acids as bleaching agents.

The deposition of silver from used photographic fixing baths by an electrolytic process has long been known. The main advantage of the electrolytic process is that it produces silver in a very high state of purity, which is advantageous for the economic aspect of the recovery process. In addition, the electrolytic process extends the useful life of the baths and reduces the consumption of chemicals and the degree of contamination of the effluent.

These advantages of the electrolytic desilvering of fixing baths are equally important for the desilvering of the bleach fix baths used in the processing of color photographic silver halide recording materials. These bleach fix baths contain in addition to the usual fixing agent a bleaching agent and have the function of oxidizing the metallic silver (bleaching) and dissolving the insoluble silver salts of the photographic recording material (fixing).

It has been found, however, that the known methods of electrolytic desilvering of fixing baths cannot be applied directly to bleach fix baths. The current yield, that is the amount of silver deposited per unit of charge in the desilvering of the bleach fix baths is considerably lower than that obtained in the desilvering of other fixing baths under the same conditions because in the case of bleach fix baths the silver bleaching agent is reduced in addition to the silver ions. Moreover, the presence of atmospheric oxygen causes trouble because it reoxidizes the reduced bleaching agent; similar trouble is caused by anodic oxidation products reaching the cathode zone.

Furthermore, when electrolysis is carried out continuously it is not possible, in the case of the bleach fix bath, to stop desilvering simply by switching off the current because the silver which has just been deposited would redissolve in the presence of excess bleaching agent and silver salt solvent.

It is the object of this invention to provide an economic process for the desilvering of used bleach fix baths which would enable the regenerated baths to be used again for photographic color processing.

A process has now been found for the electrolytic deposition of silver from used photographic bleach fix baths and in particular from bleach fix baths which contain iron(III) complex salts of aminopolycarboxylic acids, which process is characterized in that electrolysis is carried out with the exclusion of air in a cell in which the cathode and anode chambers are separated by a diaphragm, the silver being deposited at the cathode after reduction of the bleaching agent and the bleach fix bath being removed from the cell before the potential is switched off.

The invention enables bleach fix baths to be desilvered electrolytically in an economic manner by virtue of increased current yields. The bleach fix baths regenerated by the process of the invention may be reused again without any disadvantages for bleach fixing in color photographic processing. The process according to the invention moreover has the advantage over other processes of producing purer silver at lower operating costs and thus providing a better return.

These advantages are achieved by carrying out the electrolysis of the bleach fix baths in a closed cell with the cathode and anode chambers separated by a diaphragm, with the exclusion of atmospheric oxygen, and by ensuring that the electrolytic current is not interrupted for any significant length of time while the cathode and the silver deposited thereon is in contact with the solution.

An electrolytic cell suitable for carrying out the process of the invention is illustrated in the drawing.

The electrolytic cell 1 encloses the anode chamber 2 and cathode chamber 3 which are separated by the diaphragm 4. The anode 5 and cathode 6 are connected to a source of current through the two leads 7 and 8. The two inlets 18, 19 and outlets, 21, 22 for catholyte and anolyte open into the retaining rings 9, 10. The electrolytic cell is sealed by the rings 15 and kept closed by the screws 13, 14. The reference numerals 16 and 17 indicate the storage vessels for the catholyte and anolyte. The taps 20 serve to shut off or discharge the spent liquid. The circulating pumps 23 and 24 circulate the liquid through the cell. The overflow 25 carries the catholyte to the inlet 19 for anolyte and the overflow 26 removes regenerated bleach bath.

The cell operates as follows:

The bleach fix bath which is to be desilvered is fed into the storage vessel 16. The solution flows through the pipe 18 into the cathode chamber 3 of the cell 1 and passes through the outlet 21 into the pump 23 which returns it to the storage vessel 16. The diaphragm 4 enables liquid to enter slowly into the anode chamber 2 of the cell 1. As soon as the anode chamber 2 is filled, the inlet 19, outlet 22, pump 24 and storage vessel 17 of the anode side also start to fill. As soon as the storage vessel 17 contains enough liquid that the pump 24 no longer pumps air alone, current can be applied to the leads 7 and 8. In order to prevent sulfidation, that is the formation of silver sulfide, the voltage must be regulated so that the cathode 6 is not at too high a negative potential compared with the potential of a comparison electrode. The comparison electrode may be connected anywhere into the cathode circuit, e.g., in the storage vessel 16. Details of this control mechanism are known and have been described in German Patent Specification No. 1,187,806.

Filling of the cell can be greatly accelerated by also introducing bleach fix bath into the storage vessel 17 of the anode side.

The silver content of the cathode liquid which is circulated continuously between the cathode chamber 3 and storage vessel 16 falls continuously during the course of the electrolysis. The metallic silver is deposited as a coating on the cathode 6. If the liquid level in the storage vessel 16 is kept slightly higher than in the vessel 17, the cathode liquid slowly flows into the anode chamber through the diaphragm 4. The access of anodic oxidation product to the cathode can thus be largely prevented.

When the silver content of the circulating cathode liquid has fallen sufficiently, the anode liquid and cathode liquid are discharged separately through the taps 20.

The anode liquid may now also be desilvered, in which case it is transferred to the storage vessel 16 of the cathode side while the original cathode liquid is transferred to the vessel 17 of the anode side.

On further electrolysis, the iron-II complex formed in the original cathode liquid by cathodic side reaction is reoxidized to the iron-III complex required for the photographic bleach fix process. At the same time, the original anode liquid is desilvered to the desired silver content.

In the next cycle, the cathode side is recharged with bleach fix bath containing a high concentration of silver from the photographic process, the desilvered cathode liquid is transferred to the storage vessel 17 of the anode side and the anode liquid is treated with regenerator additives in the usual manner and returned to the processing bath.

The time required for electrolysis depends on the desired degree of desilvering. The anodic reoxidation of the ferrous complex to the ferric complex might therefore generally not be completed but, if desired, it may be completed by treating the solution briefly with atmospheric oxygen. There is no harm in keeping the solution for a long time in the anode side of the electrolytic apparatus provided the solution contains sufficient sulfite and is replenished with sulfite if necessary. When the cell has been recharged a sufficient number of times with used photographic bleach fix baths, it may be dismantled by releasing the screws 13 and 14 and the silver may then by recovered from the cathode.

The current yield must necessarily be lower in the desilvering of bleach fix baths than in the desilvering of normal fixing baths because the bleaching agent in the bleach fix baths, in this particular case the iron(III) complex of an aminopolycarboxylic acid, is also reduced at the cathode. The desilvering process according to the invention is therefore particularly suitable for bleach fix baths which contain complex Fe(III) salts of aminopolycarboxylic acids as bleaching agent and in which the bleaching agent has been reduced before the desilvering process. Reduction of the iron(III) complex may be carried out, for example, simply by adding sodium dithionite as reducing agent to the bleach fix bath. The amount of reducing agent added should be less than the stoichiometric quantity based on the iron(III) complex in the bleach fix bath. In general, it is sufficient to add e.g. 8 g of dithionite to 1 l of bleach fix bath. The method of preliminary reduction of bleach fix baths which contain iron (III) complex salts of aminopolycarboxylic acids has been described in German Patent Specification (P 21 37 549.5).

The current yield and hence the economy of the electrolysis therefore can be further improved by combining the process of preliminary reduction mentioned above with the electrolytic process of the invention. If the bleaching agent has previously been reduced, the current intensity required for desilvering the bleach fix bath by the process of the invention is only about 1/5th of that required when electrolysis is carried out without prior reduction.

The process of the invention may be carried out either batchwise as described above or continuously. The process for continuous operation of the electrolytic cell is carried out as follows:

The cell is put into operation as described above. Bleach fix bath contaminated with silver is then fed continuously into the storage vessel 16 from the overflow of the photographic development machine but care should be taken to ensure that the silver content does not exceed a predetermined low value.

Sodium dithionite is then added continuously at the required rate. Cathode liquid slowly flows into the anode chamber 2 through the diaphragma 4. After a certain starting up time after the cell has been filled, during which the bleach fix bath at the overflow 26 still has a high silver content, reoxidized bleach fix bath which has the low silver content to which the operation is adjusted can be continuously removed from the overflow 26 of the storage vessel 17 of the anode side. Regenerator additives may be added to this reoxidized bleach fix bath and, if desired, reoxidation may be completed with atmospheric oxygen and the bath may be returned to the photographic processing apparatus.

The density of the diaphragm 4 should be such that the rate of flow through it is slightly lower than that which would correspond to the rate of addition of bleach fix bath and the rate of electrolysis, because otherwise there would be too great a risk of iron-III complex formed at the anode returning to the cathode. The liquid is nevertheless kept at a constant level by the overflow 25 through which the excess of cathode liquid flows from the storage vessel 16 of the cathode side to the anode side. Similarly to the case of batchwise operation, when the cell has been in operation for a sufficient length of time, the solutions must be discharged and the cell dismantled to recover metallic silver from the cathode.

When the bleach fix bath has been electrolytically desilvered by the process of the invention, regenerator substances are added to it in the usual manner to make it ready for reuse.

The invention will now be further explained with the aid of the following Examples.

EXAMPLE 1

A bleach fix bath containing 10 g of ethylenediaminotetraacetic acid,
40 g of iron-III complex of ethylenediaminotetraacetic acid,
2 g of sodium sulfite,
12 g of tertiary sodium phosphate and
100 g of a commercial mixture of 20% of sodium thiosulfate and 80% of ammonium thiosulfate per liter and having a pH of 7.5 is used until its silver content is about 2.16 g/l (3.75 g/l of AgBr).

1.5 l of this solution are electrolysed in a cell in which the anode and cathode chamber have a diameter of 100 mm and a depth of 8 mm. The diaphragm consists of a glass frit G 4 and has a diameter of 90 mm.

The cathode consists of VA steel and the anode of graphite. The solution is circulated at the rate of about 0.5 l per minute. At a given potential of 620 mV against a saturated calomel electrode, the current, after a brief period of induction, is established at 400 mA = 5 mA/cm$^2$.

The current drops to 350 mA in the course of 6 hours and then to 280 mA after 8 hours.

1.7 g of silver are deposited on the cathode during this time. The silver content of the solution is then 0.9 g/l in the cathode chamber and 2.1 g/l in the anode chamber.

The pH of the solution in the anode chamber changes from 7.5 to 7.35 during this time but that in the cathode chamber changes to 8,35. The equilibrium rest potential of a platinum electrode in a sample of anode liquid, measured against the saturated calomel electrode, remains in the region of 0 to −70 mV during the whole time of electrolysis. The corresponding potential of the cathode liquid falls to −250 mV in the course of electrolysis.

If a substantially lower potential is applied, for example 380 mV, only 0.3 g of silver are deposited during the same length of time. The pH of the anode liquid again remains practically unchanged while that of the cathode liquid rises from 7.5 to 7.8. The potential of a platinum electrode in the anode liquid fluctuates between 0 and 40 mV whereas in the cathode liquid it gradually drops to −125 mV. The current slowly increases in the course of this time from 60 mA to 130 mA (corresponding to 0.8 to 1.6 mA/cm²). The silver content of the anode liquid does not change and that of the cathode liquid only falls to 1.91 g/l.

At potentials intermediate between those indicated above, the increase in silver yield is approximately linear.

EXAMPLE 2

Example 1 is modified in that the bleach fix bath is reduced by the addition of 8.7 g of dithionite per liter before electrolysis. This quantity of dithionite causes a color change from deep red to pale yellow, indicating the reduction of the trivalent to a divalent iron complex.

This addition of dithionite causes a shift of the pH into acid. 2.5 g/l of sodium phosphate is added to improve the buffering capacity and the pH is returned to the nominal value of 7.5 by means of potassium carbonate.

The equilibrium rest potential of a platinum electrode in this solution measured against a saturated calomel electrode is −180 mV.

If a potential of 600 mU against saturated calomel electrode is applied to the cathode, 1.5 g of silver are deposited in 8 hours. The silver content of the solution is then 1.02 g/l in the cathode chamber and 1.82 g/l in the anode chamber.

The current is initially about 80 mA and falls to slightly above 50 mA during the electrolysis.

When a potential of 380 mV is applied, the corresponding values are 0.8 g of silver and 1.40 g/l and 1.65 g/l, respectively.

Preliminary reduction with dithionite therefore has the effect that the potential may be kept further from the danger limit of sulfidation while satisfactory yields may nevertheless be achieved.

What we claim is:

1. A method for electrolytically recovering silver from spent aqueous bleach-fix photographic processing solution containing ions of both silver and iron III comprising introducing into said processing solution a chemical compound characterized by the ability to reduce iron III to iron II, impressing a direct electrical current between a cathode which is immersed in a first pool of such processing solution and an anode which is immersed in a second pool of anolyte solution, thereby plating silver onto said cathode, said first and second pools being separated from one another by a non-porous cation permeable barrier or a porous barrier, and excluding air from said pools.

2. A method in accordance with claim 1 wherein said chemical compound is sodium dithionite.

3. A method in accordance with claim 1 wherein said processing solution is a bleach-fix solution which comprises a ferric salt of an amino polycarboxylic acid as bleaching agent and a thiosulfate as fixing agent.

4. A method in accordance with claim 1 wherein said processing solution is a bleach-fix solution which comprises a ferric salt of ethylene diaminetetraacetic acid as bleaching agent and a thiosulfate as fixing agent.

5. A method for electrolytically recovering silver from spent aqueous bleach-fix photographic processing solution containing ions of both silver and iron III comprising introducing into said processing solution a chemical compound characterized by the ability to reduce iron III to iron II, impressing a direct electrical current between a cathode which is immersed in a first pool of such processing solution and an anode which is immersed in a second pool of anolyte solution, thereby plating silver onto said cathode, said first and second pools being separated from one another by a non-porous cation permeable barrier or a porous barrier, excluding air from said pools, and regenerating said processing solution by introducing oxygen therein after removal of silver therefrom.

* * * * *